United States Patent [19]

Gerhard

[11] 4,060,174

[45] Nov. 29, 1977

[54] SELF-CONTAINED DOUBLE-TUBULAR TRANSPORT CONTAINER

[75] Inventor: Helmut Gerhard, Weitefeld, Sieg, Germany

[73] Assignee: Westerwalder Eisenwerk Gerhard KG, Germany

[21] Appl. No.: 614,308

[22] Filed: Sept. 17, 1975

[30] Foreign Application Priority Data

Sept. 26, 1974 Germany ..... 7432279[U]

[51] Int. Cl.[2] ..... B65D 21/02

[52] U.S. Cl. ..... 220/23.4; 105/362; 220/84; 220/1.5; 220/23.6; 220/85 H; 220/85 S; 248/146

[58] Field of Search ..... 220/1 B, 9 A, 9 LG, 220/23.4, 23.6, 23.83, 23.86, 85 H, 85 S, 23.2, 84, 5 A, 1.5 R; 105/362, 366 E; 359/60; 248/146, 119 R

[56] References Cited

U.S. PATENT DOCUMENTS

| | | | |
|---|---|---|---|
| 771,589 | 10/1904 | Vanderbilt | 105/362 |
| 1,608,226 | 11/1926 | Mauran | 105/362 |
| 1,627,650 | 5/1927 | Katzinger | 220/23.2 |
| 1,649,432 | 11/1927 | Willoughby et al. | 105/362 |
| 1,661,000 | 2/1928 | Madden et al. | 105/362 |
| 2,048,312 | 7/1936 | Zulver | 220/85 S |
| 3,058,753 | 10/1962 | Carlsen | 220/23.2 |
| 3,292,324 | 12/1966 | Cole | 220/23.2 |
| 3,730,384 | 5/1973 | Ramme | 220/1 B |
| 3,799,383 | 3/1974 | Gerhard | 220/1.5 |
| 3,820,492 | 6/1974 | Yamamoto | 220/9 LG |

FOREIGN PATENT DOCUMENTS

| | | | |
|---|---|---|---|
| 1,406,653 | 6/1964 | France | 105/362 |
| 730,239 | 1/1943 | Germany | 105/362 |

*Primary Examiner*—William Price
*Assistant Examiner*—Joseph Man-Fu Moy
*Attorney, Agent, or Firm*—Craig & Antonelli

[57] ABSTRACT

With a view to eliminating the annealing of the entire container for stress-relieving purposes after assembly and to prevent excessive stressing of its tanks, a self-contained transport container with two adjacent and rigidly interconnected cylindrical liquid tanks has the tanks screwed together with each other and with saddle elements and intermediate saddles via T-members and additional transverse connecting members.

14 Claims, 4 Drawing Figures

SELF-CONTAINED DOUBLE-TUBULAR TRANSPORT CONTAINER

This invention relates to a self-contained double-tubular transport container with two adjacent cylindrical liquid tanks which are rigidly interconnected at least at their terminal regions and which are connected with head elements for the purpose of stacking and lifting the container via saddle elements arranged substantially diagonally with respect to the tank cross-section, said tanks being further connected with at least two transverse intermediate saddles arranged between the ends of the container.

The double-tubular containers of this kind which have previously been proposed are welded together with one another and with the head elements. The welding causes stresses which are neither desirable nor acceptable, particularly in the case of tanks for gas under high pressure. Consequently the entire container has to be stress-relieved by annealing after assembly, which is extremely expensive.

This applies particularly where, in accordance with more recent ISO-regulations, additional supports between the ends of the container are provided on the underside of the container.

The transverse intermediate saddles required for such supports entail additional welding and result in stresses which have to be introduced directly into the tubular tanks, since the bearing forces transmitted by said supports can or should not be accommodated by the head elements.

It is an object of the invention to eliminate the annealing of the entire container hitherto necessary for stress-relieving purposes after assembly and to prevent excessive stressing of the tubular tanks in the vicinity of the intermediate saddles mentioned.

For this purpose the tubular tanks are, in accordance with the invention, screwed together with each other and with the saddle elements and intermediate saddles via welded-on T-members and additional transverse connecting members are provided in the upper region of the tubular tanks.

Thanks to this screw connection the tubular tanks can be individually produced and stress-relieved by annealing, prior to being screwed together with the head elements and the transverse connecting members to form a container. No further welding of the tanks is required during assembly. Consequently the container can without difficulty withstand high test pressures and is suitable for transporting dangerous gases under high pressure. By reason of the screw connection with the intermediate saddles on the one hand and with the top transverse connecting members on the other hand, a rigid bundle of the two tubular tanks is achieved in the critical support regions.

Accordingly the self-contained double-tubular transport container in accordance with the invention consists of two head elements with corner fittings for stacking and lifting the container, two adjacent cylindrical liquid tanks extending between the head elements, upper and lower saddle elements arranged diagonally with respect to the tank cross-section for connecting the liquid tanks with the head elements, at least two intermediate saddles arranged at different locations along the length of the container and extending along the latter's underside transversely to its longitudinal direction for interconnecting the cylindrical liquid tanks, transverse connecting members arranged above the horizontal centre line of the cylindrical tanks and first, second and third T-members which are welded to suitable regions of the tanks, which extend in the longitudinal direction of the latter and which are screwed respectively to the saddle elements, the intermediate saddles and the transverse connecting members.

One embodiment of the invention is characterised by fourth T-members welded in the region of the head elements to the cylindrical tanks in the horizontal central planes of the latter for screwing the tanks together.

In accordance with a further embodiment, each transverse connecting member consists of a suitably cut tent-shaped sheet metal element which has two folds and is reinforced by folds or superimposed angle sections, which is screwed to the third T-members.

Preferably the lower saddle elements and the first T-members associated therewith are provided with inter-engaging locking lobes for preventing relative longitudinal displacement of the head elements and the cylindrical tanks.

An embodiment of the invention is shown in the drawing, in which.

Figure 1:
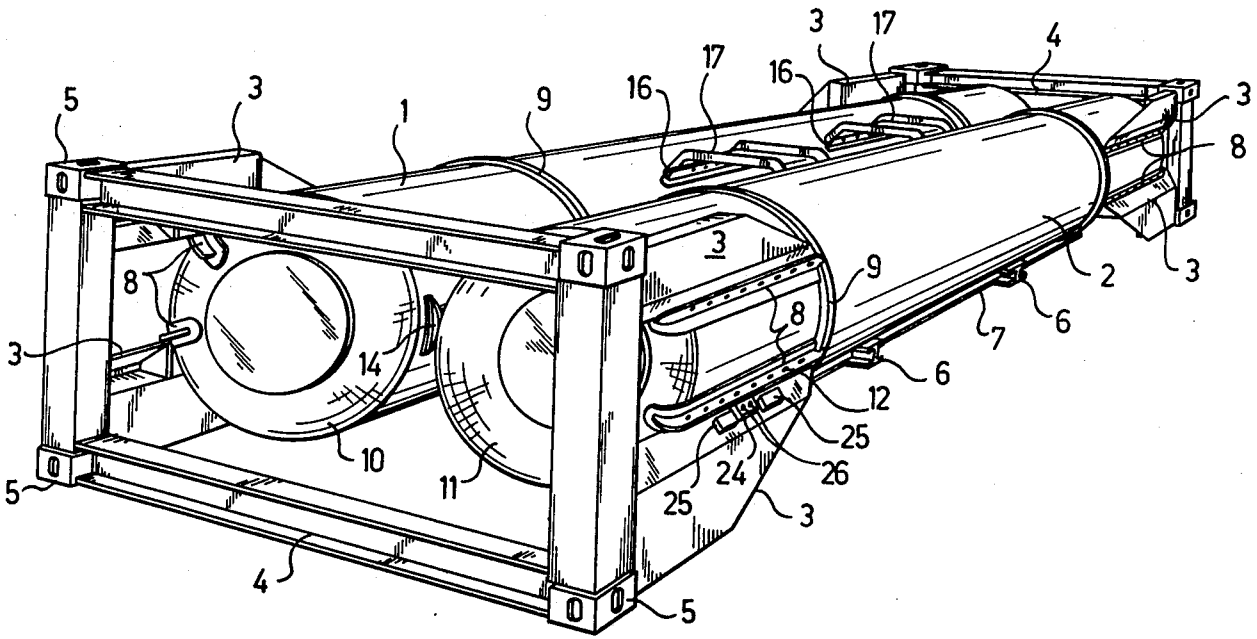
FIG. 1 shows a general view of the new transport container.

In the container shown, two tubular tanks 1 and 2 are arranged parallel to each other and are connected via saddle elements 3 (extending diagonally to the tube cross-section) with head elements 4, which have corner fittings 5 for stacking and lifting the tank.

Further supports are formed by transverse saddle elements 6 which are located along approximately one third of the length of the container and which are also connected to the tubular tanks 1 and 2. The tanks 1 and 2 are reinforced at the centre of their underside by T-shaped longitudinal sections 7 welded thereto.

For the purpose of connecting the tubular tanks 1 and 2 with the saddle elements 3, longitudinally extending T-members 8 are welded to the tubular tanks approximately in the 45° planes of the latter, the T-members 8 extending on the outside of the container from reinforcing rings 9, which surround the tubular tanks and are welded thereto to the bottoms 10, 11 of the tubular tanks and extending partially over part of the arched bottoms. The webs of the T-members 8 are provided with holes which are aligned with corresponding holes in the saddle elements 3 and serve the purpose of receiving bolts 12.

. For additionally transmitting the acceleration forces acting in the longitudinal direction of the tanks, a lobe 24 is welded to the T-member 8, which engages between two locking lobes 25 secured to the lower saddle element 3. The lobe 24 may additionally be secured to the saddle element by means of bolts 26. In this way the transmission of the forces acting along the longitudinal axis to the lower saddle element is ensured.

At the sides facing each other, the tanks 1 and 2 carry T-members 13 which also extend in the longitudinal direction, which are welded thereto at the level of the horizontal central plane of the tanks and which extend from the reinforcing rings 9 to short vertical T-members 14 which are welded to the tanks. In combination with the T-members 14, the reinforcing rings 9 provided against external excess pressure additionally accommodate acceleration- and braking forces in the longitudinal direction. The T-members 13 are connected together by means of bolts 15. In this way the tubular tanks 1 and 2 have a plurality of rigid interconnections in the region of the head elements.

Figure 3:
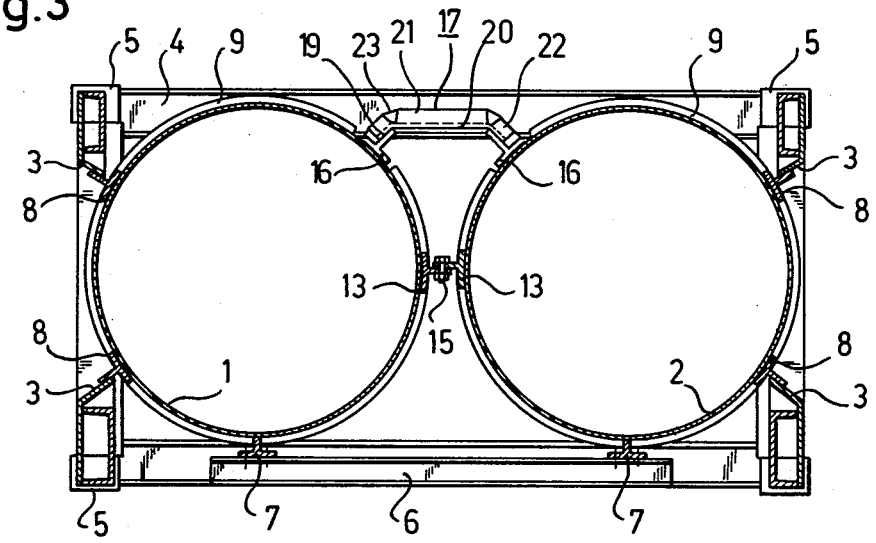
FIG. 3 shows a cross-section along the line III—III in FIG. 2.
Figure 2:
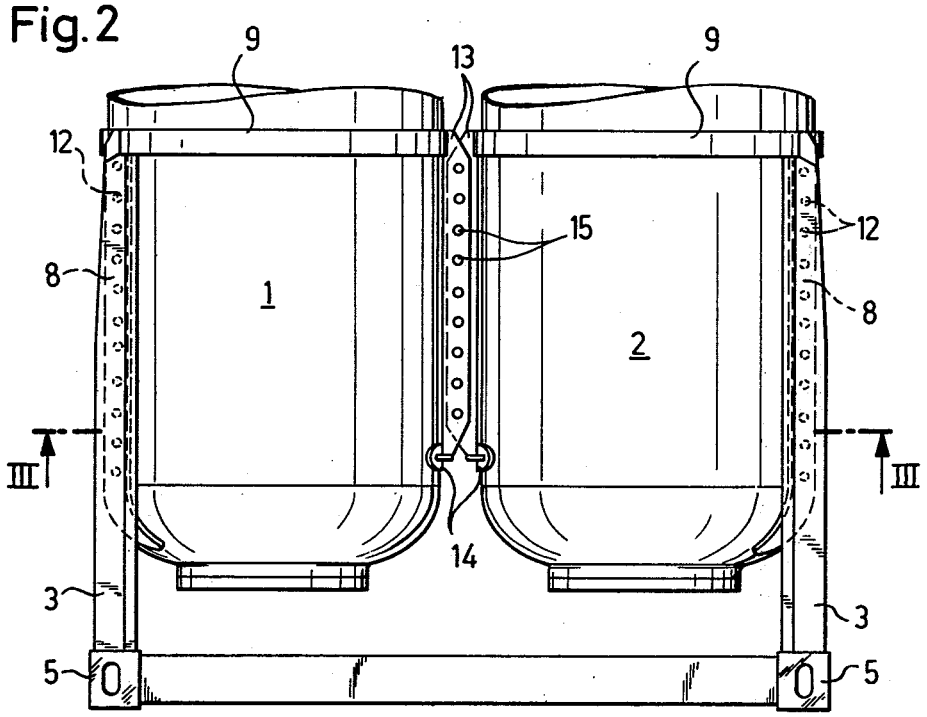
FIG. 2 shows a plan of the left hand head element of the latter.
Figure 4:
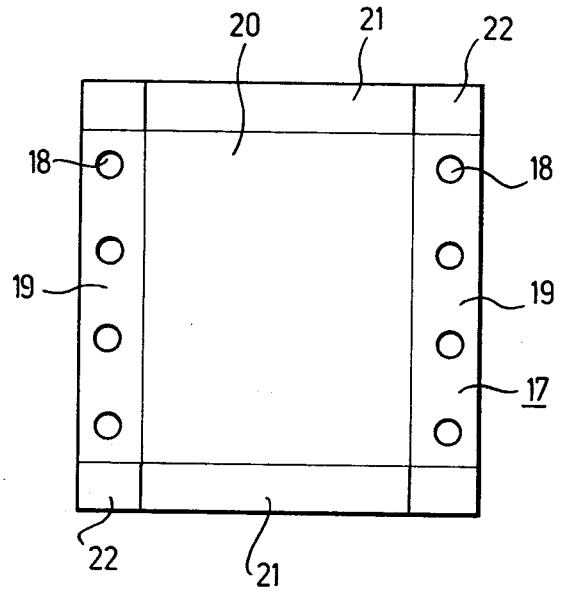
FIG. 4 shows a top transverse connecting member developed and to a larger scale.

The transverse intermediate saddles 6 are also screwed to the base sections 7 extending along the tanks. Furthermore longitudinally extending T-members 16 are welded to the relatively facing sides of the tanks at the same locations of the longitudinal direction of the tubular tanks 1 and 2 as the intermediate saddles 6 approximately at the level of the 45°-diagonals of the tank cross-sections above the horizontal central plane. These T-members 16 are each screwed to a transverse connecting member 17. As can be seen from FIGS. 3 and 4, the transverse connecting member 17 is formed by a rectangular cut sheet metal element, whose side portions 19 are provided with holes 18 and bent downwards through approximately 45° with respect to the horizontal central portion 20. The frontal sides 21, 22 of the cut element are cut at the locations of the bends and bent upwards through 90°. The gussets formed by this bending are filled in with triangular sheet metal elements 23. In this way a joint is formed which is resistant to bending, pressure and twisting, providing a rigid transverse connection between the two tubular tanks 1 and 2 at those locations at which the two tanks are additionally stressed via the transverse saddles 6 by supporting forces.

During assembly, the two tubular tanks are first manufactured individually and provided with the reinforcing rings 9, the base sections 7 and the T-members 8, 13, 14 and 16. Upon completion of this welding operation, the tanks are individually stress relieved by annealing. The further assembly involves no further welding on the tanks themselves, but the latter are merely screwed, by means of the T-members welded thereto, to the saddle elements 3, the transverse intermediate saddles 6 and the transverse connecting members 17. Furthermore, they are screwed together by means of the T-members 13 in the regions of the head elements.

I claim:

1. A self-contained double-tubular transport container comprising two end sections with corner fittings for stacking and lifting the container; two adjacent cylindrical liquid tanks extending between the end sections; upper and lower saddle elements arranged diagonally with respect to the tank cross-section for connecting the cylindrical tanks to the end sections; at least two intermediate saddles arranged at different locations along the length of the container and extending along the underside thereof transversely to a longitudinal direction for interconnecting the cylindrical tanks; transverse connecting members arranged above the horizontal center line of the cylindrical tanks; and first, second and third T-members welded to suitable regions of the cylindrical tanks, said T-members extending in the longitudinal direction of said tanks and being bolted respectively to the saddle elements, the intermediate saddle and the transverse connecting members.

2. A self-contained double-tubular transport container according to claim 1, comprising fourth T-members welded in the region of the end sections to the cylindrical tanks in the horizontal central planes of said tanks for bolting the tanks together.

3. A transport container according to claim 2, wherein said fourth T-members are bound in the longitudinal direction by fifth T-members welded to the tanks and extending in the circumferential direction of the cylindrical tanks.

4. A transport container according to claim 1, wherein each transverse connecting member consists of a suitably cut tent-shaped sheet metal element which has two folds and is reinforced by folds or superimposed angled sections.

5. A transport container according to claim 1, wherein the lower saddle elements and the first T-member associated therewith are provided with inter-engaging locking lobes for preventing relative longitudinal displacement of the end sections and the cylindrical liquid tanks.

6. A transport container according to claim 1, wherein each tank is provided with at least one reinforcing ring surrounding the tank, and wherein said first and second T-members extend from said reinforcing ring to adjacent an extreme longitudinal end of said tank.

7. A transport container according to claim 2, wherein each tank is provided with at least one reinforcing ring surrounding the tank, and wherein said first, second and fourth T-members extend from said reinforcing ring to adjacent an extreme longitudinal end of said tank.

8. A transport container according to claim 3, wherein each tank is provided with at least one reinforcing ring surrounding the tank, and wherein said first, second and fourth T-members extend from said reinforcing ring to adjacent an extreme longitudinal end of said tank.

9. A transport container according to claim 5, wherein each tank is provided with at least one reinforcing ring surrounding the tank, and wherein said first, second and fourth T-members extend from said reinforcing ring to adjacent an extreme longitudinal end of said tank.

10. A self-contained transport container comprising:

head means, two adjacent fluid tanks extending between the head means, head saddle means attached to and carried by said head means, support members welded to suitable regions of the cylindrical tanks, and bolt means connecting said support members to said head saddle means, whereby said cylindrical tanks and support members can be assembled and annealed separate from said head means and said head saddle means prior to connection thereof by said bolt means;

wherein at least some of said support members have a T-shaped cross-section and extend in the longitudinal direction of the tanks with the head portion of the T-shaped cross-section welded directly to one of said tanks and the leg portion of the T-shaped cross-section including apertures for accommodating said bolt means, four of said T-shaped cross-section support members being disposed adjacent each end of each of said tanks and spaced circumferentially from one another, a first of said T-shaped cross-section support members at one tank being directly bolted to a corresponding first T-shaped cross-section support member at the other tank, a second and a third of said T-shaped cross-section support members being boltingly connected to said head saddle means, the second of said T-shaped cross section support members includes a lobe member welded thereto, and wherein the respective saddle members bolted to said second of said T-shaped cross-section support members includes a pair of locking lobes, one at each longitudinal end of said lobe member, for accommodating transfer of longitudinal forces between said saddle members and said support members.

11. A transport container according to claim 10, wherein said head means includes corner fittings for accommodating stacking and lifting of said container.

12. A self-contained transport container comprising:

head means, two adjacent fluid tanks extending between the head means, head saddle means attached to and carried by said head means, support members welded to suitable regions of the cylindrical tanks, and bolt means connecting said support members to said head saddle means, whereby said cylindrical tanks and support members can be assembled and annealed separate from said head means and said head saddle means prior to connection thereof by said bolt means;

wherein at least some of said support members have a T-shaped cross-section and extend in the longitudinal direction of the tanks with the head portion of the T-shaped cross-section welded directly to one of said tanks and the leg portion of the T-shaped cross-section including apertures for accommodating said bolt means, four of said T-shaped cross-section support members being disposed adjacent each end of each of said tanks and spaced circumferentially from one another, a first of said T-shaped cross-section support members at one tank being directly bolted to a corresponding first T-shaped cross-section support member at the other tank, a second and a third of said T-shaped cross-section support members being boltingly connected to said head saddle means, further comprising transverse connecting members arranged above the horizontal center line of said tanks, and wherein a fourth of said T-shaped cross-section support members at said one tank is boltingly connected to one end of said transverse connecting members and a corresponding fourth T-shaped cross-section support member at the other tank is boltingly connected to the other end of said one of said transverse connecting members, wherein each of said tanks is provided with a pair of reinforcing rings spaced from one another in the longitudinal direction of said tanks, wherein the first, second, and third of said T-shaped cross-section support members extend from a respective one of said reinforcing rings toward the end of the respective tank opposite from the other reinforcing ring of said tank, the second of said T-shaped cross-section support members includes a lobe member welded thereto, and wherein the respective saddle members bolted to said second of said T-shaped cross-section support members includes a pair of locking lobes, one at each longitudinal end of said lobe member, for accommodating transfer of longitudinal forces between said saddle members and said support members.

13. A self-contained transport container comprising:

head means, a plurality of adjacent tanks extending between the head means, head saddle means attached to and carried by said head means, support members welded to suitable regions of the tanks, and readily detachable connecting means connecting said support members to said head saddle means, whereby said tanks and support members can be assembled and annealed separate from said head means and said head saddle means prior to connection thereof by said readily detachable connecting means;

wherein at least some of said support members have a profile cross-section with a first flange portion welded directly to the surface of one of said tanks and a second flange portion extending at an angle from said first flange portion and including aperture means to accommodate said connecting means, four of said profile cross-section support members being disposed adjacent each end of each of said tanks and spaced circumferentially from one another, a first of said profile cross-section support members at one tank being directly detachably connected to a corresponding first profile cross-section support member at the other tank, a second and third of said profile cross-section support members being detachably connected to said head saddle means, the second of said profile cross-section support members includes a lobe member welded thereto, and wherein the respective saddle members detachably connected to said second of said profile cross-section support members includes a pair of locking lobes, one at each longitudinal end of said lobe member, for accommodating transfer of longitudinal forces between said saddle members and said support members.

14. A transport container according to claim 13, wherein said head means includes corner fittings for accommodating stacking and lifting of said container.

* * * * *